US008669722B2

(12) United States Patent
Yeh et al.

(10) Patent No.: US 8,669,722 B2
(45) Date of Patent: Mar. 11, 2014

(54) COLOR TEMPERATURE ADJUSTMENT FOR LED LAMPS USING SWITCHES

(75) Inventors: Wei-Yu Yeh, Tainan (TW); Chih-Hsuan Sun, Kaohsiung (TW)

(73) Assignee: TSMC Solid State Lighting Ltd., Hsin-Chu (TW)

( * ) Notice: Subject to any disclaimer, the term of this patent is extended or adjusted under 35 U.S.C. 154(b) by 277 days.

(21) Appl. No.: 13/209,327

(22) Filed: Aug. 12, 2011

(65) Prior Publication Data

US 2013/0038222 A1 Feb. 14, 2013

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 37/02*** | (2006.01) |
| ***H05B 39/04*** | (2006.01) |
| ***H05B 41/36*** | (2006.01) |
| *G05F 1/00* | (2006.01) |
| *G01J 5/60* | (2006.01) |

(52) U.S. Cl.
USPC ..... 315/313; 315/152; 315/185 R; 315/294; 356/45

(58) Field of Classification Search
None
See application file for complete search history.

(56) References Cited

U.S. PATENT DOCUMENTS

| | | | | |
|---|---|---|---|---|
| 7,344,952 | B2 | 3/2008 | Chandra | |
| 7,902,560 | B2 | 3/2011 | Bierhuizen et al. | |
| 2010/0295456 | A1* | 11/2010 | Ko | 315/154 |
| 2011/0068702 | A1* | 3/2011 | van de Ven et al. | 315/186 |
| 2012/0306375 | A1* | 12/2012 | van de Ven | 315/122 |

* cited by examiner

*Primary Examiner* — Douglas W Owens
*Assistant Examiner* — Dedei K Hammond
(74) *Attorney, Agent, or Firm* — Haynes and Boone, LLP

(57) ABSTRACT

A light-emitting diode (LED) lamp includes a number of different color LEDs that can be turned on and off in different combinations using an external switch operable by a user. A user or a controller can adjust the color temperature of light output by the lamp. The color temperature change may be a user preference and can compensate for decreased phosphor efficiency over time.

21 Claims, 7 Drawing Sheets

COLOR TEMPERATURE ADJUSTMENT FOR LED LAMPS USING SWITCHES

FIELD OF THE INVENTION

The present disclosure relates generally to a light-emitting diode (LED) lamp and, more particularly, to a method and design that allows a user to adjust the lamp color temperature.

BACKGROUND

A Light-Emitting Diode (LED), as used herein, is a semiconductor light source including a semiconductor diode and optionally photoluminescence material, also referred to herein as phosphor, for generating a light at a specified wavelength or a range of wavelengths. LEDs are traditionally used for indicator lamps, and are increasingly used for displays and general illumination. An LED emits light when a voltage is applied across a p-n junction formed by oppositely doping semiconductor compound layers. Different wavelengths of light can be generated using different materials by varying the bandgap of the semiconductor layers and by fabricating an active layer within the p-n junction. Additional phosphor material changes the properties of light generated by the LED.

In LED lamps, multiple LEDs are often used in a circuit to generate the light output by the lamp. A white light LED usually generates a polychromatic light through the application of one or more phosphors. The phosphors shift blue light or other shorter wavelength light to a longer wavelength through a phenomenon called a Stokes shift. The perception of white may be evoked by generating mixtures of wavelengths that stimulate all three types of color sensitive cone cells (red, green, and blue) in the human eye in nearly equal amounts and with high brightness compared to the surroundings in a process called additive mixing.

LED lights can last longer and use less electricity than traditional bulbs and thus their use is becoming more widespread. However, the white point of the light can move as the different LEDs and phosphor age at different rates. User preferences for different color temperatures (warmer yellow versus cooler blue) of the white light also create a market for user adjustable color temperatures. Cost-effective and user-friendly methods to adjust color temperature are sought.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
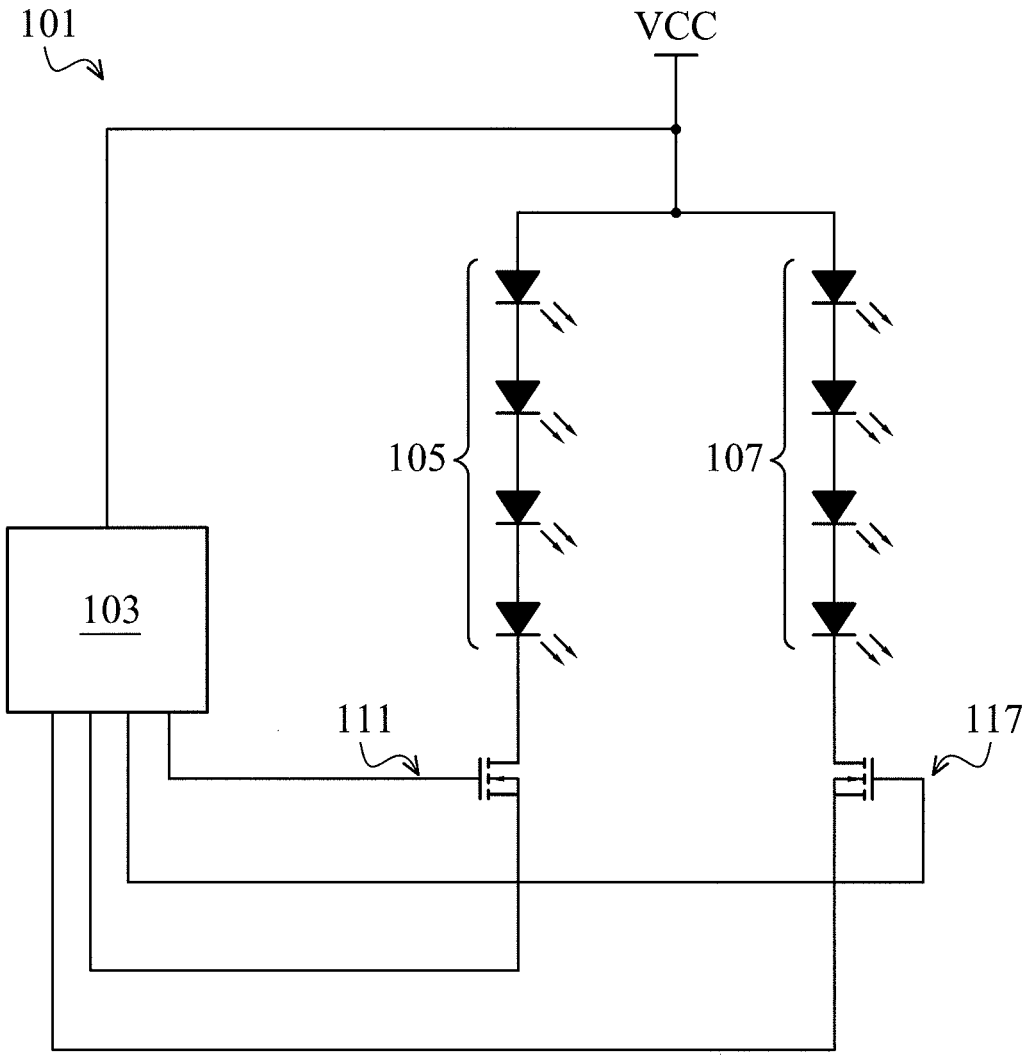
Fig. 1A ( Prior Art )
FIGS. 1A and 1B illustrate LED lamp circuits that allow color temperature adjustment.

It is understood that the following disclosure provides many different embodiments, or examples, for implementing different features of various embodiments. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Figure 1B:
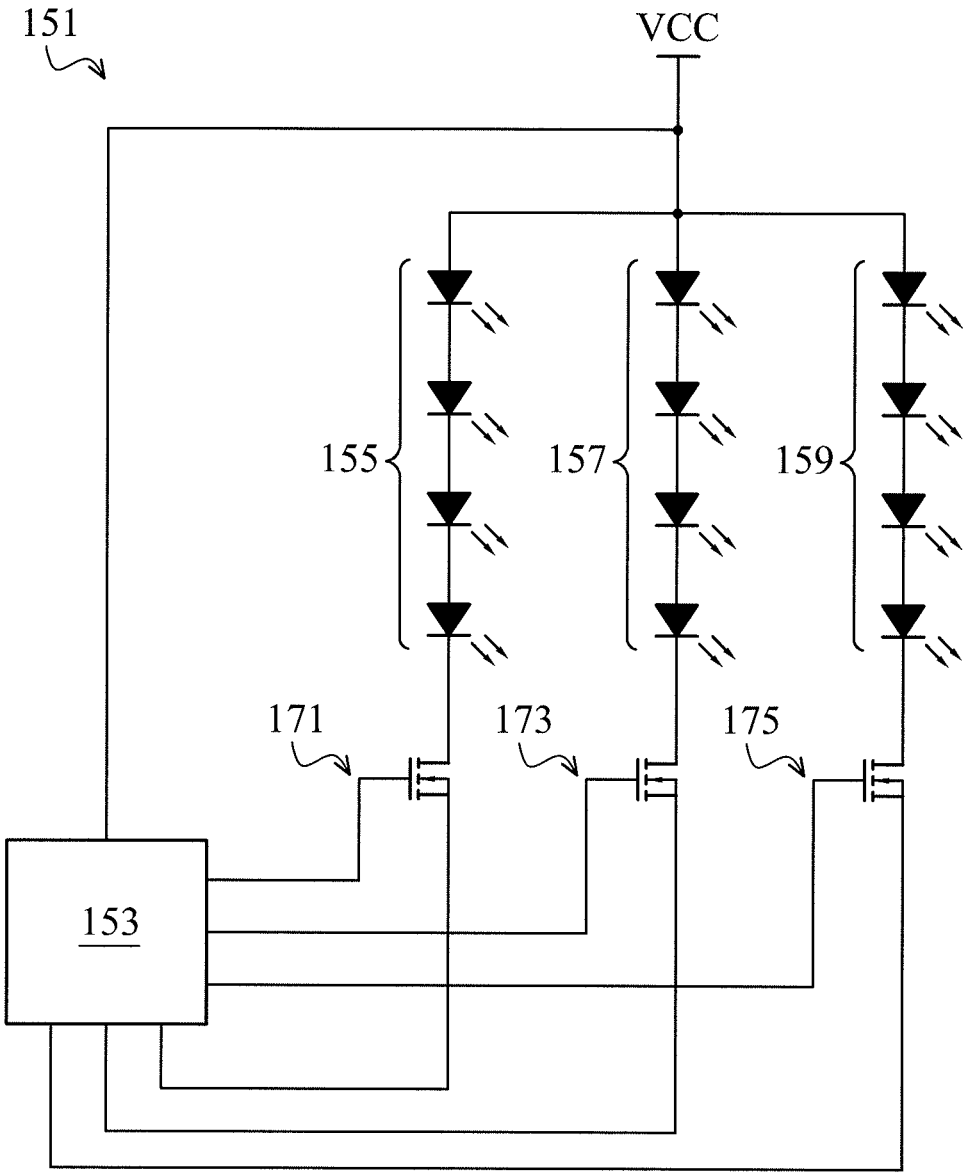
Fig. 1B ( Prior Art )

Illustrated in FIGS. 1A and 1B are different LED lamp circuits that allow color temperature adjustment. In FIG. 1A, an LED lamp circuit 101 uses two series of white LEDs 105 and 107, each with a different color temperature output. Control signals 111 and 117 from controller 103 control the current through the separate LED series to allow color temperature adjustment. For example, LED series 105 may emit a cooler white color and LED series 107 may emit a warmer white color. A cooler white color has a higher color temperature, for example, at greater than 4500K and may appear to have a blue tint, similar to daylight. A warmer white color has a lower color temperature, for example, at less than 4500K and may appear to have a yellow tint. If a warmer color is desired, then the controller 103 would direct LED series 107 to emit more light by increasing the current through the LED series 107 and direct LED series 105 to emit less light by decreasing the current to the LED series 105. However, the LED lamp circuit of FIG. 1A uses two independent constant current power sources, both of which include components that are costly.

In another example, an LED lamp circuit 151 uses a number of series of LEDs that each emits a different color and the different colors mix to a white light. FIG. 1B shows a LED lamp circuit that uses three LED series 155, 157, and 159. The three LED series may be blue, green, and red, for example. The LED series 155, 157, and 159 are controlled separately by controller 153. Controller 153 sends a control signal 171 to allow a first current through the first LED series 155, a control signal 173 to allow a second current through the second LED series 157, and a control signal 175 to allow a third current through the LED series 159. At the beginning of the lamp circuit's life, the first, second, and third currents may be the same. As the different LEDs age and as user preferences change, the controller can change the control signal to change the output color temperature. For example, if a warmer color is desired, then a control signal 175 to the red LED series 159 may be changed so that more current is passed through the red LEDs. Using this type of circuit, any color, not just white color, may be outputted by the LED lamp circuit. The LED lamp circuit of FIG. 1B uses three or more independent constant current power sources each of which includes components that are costly. Some of these components, such as electrolytic capacitors and inductors, may also have lower lifetimes as compared to the LEDs, which reduces the overall reliability of the LED lamp.

Figure 2A:
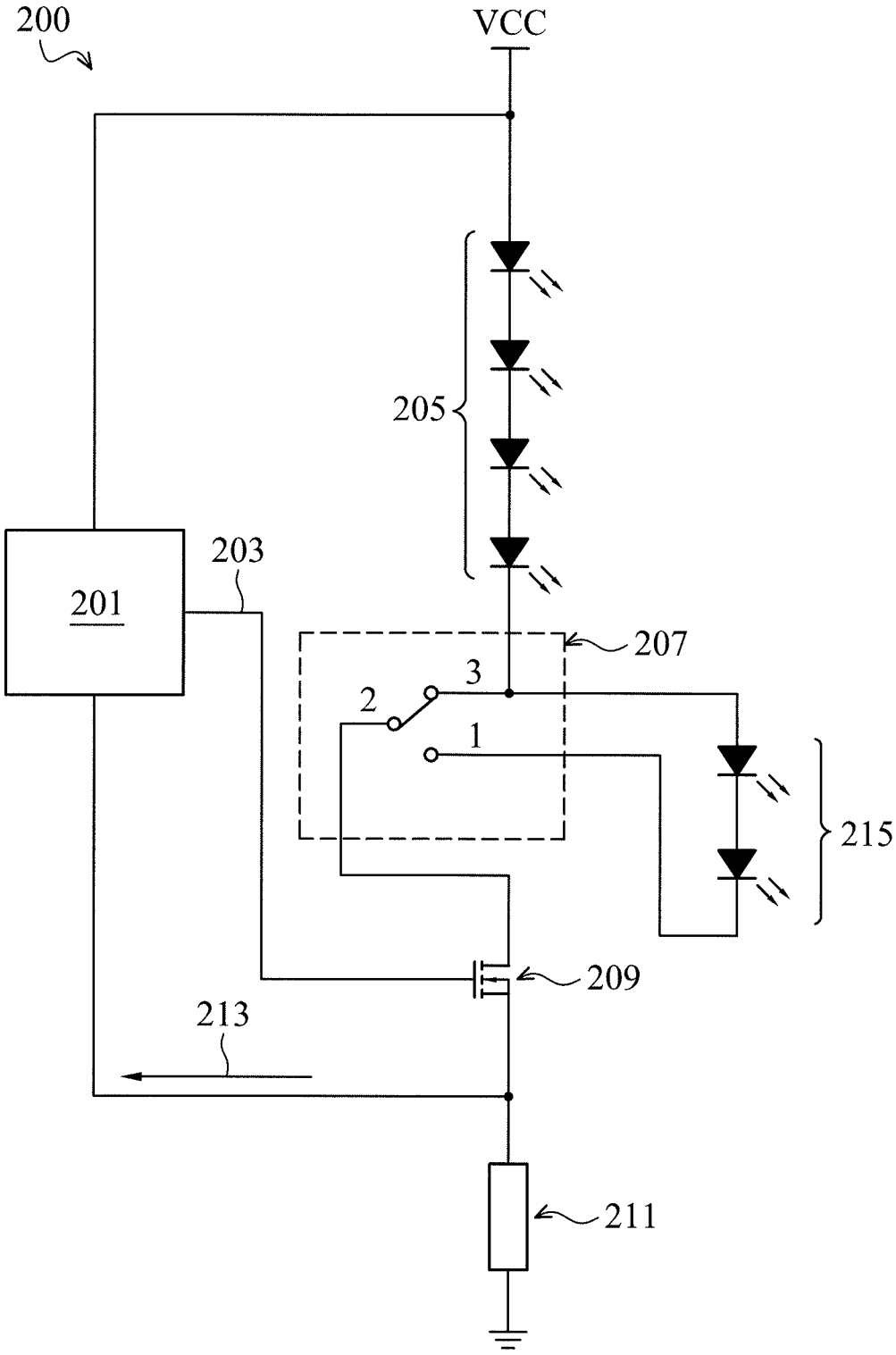
FIGS. 2A and 2B are block circuit diagrams illustrating an LED lamp circuit according to certain embodiments of the present disclosure.

FIG. 2A shows an LED lamp circuit 200 according to various embodiments of the present disclosure. The LED lamp circuit 200 avoids using multiple constant current power supplies. The LED circuit 200 includes one white LED series 205. The white LED series 205 includes a number of LEDs in series whose combined forward voltage is within an operating range of a constant current power supply. The high voltage end of the LED series 205 is connected to a floating voltage supply (vcc) and the low voltage end of the series 205 is connected to a switch 207.

The switch 207 has an internal portion that is directly connected to the LED series and may also include an external portion that can be adjusted by a user. Internal switch 207 includes at least two positions. In a first position shown as a connection between points 2 and 3, the LED series 205 is connected to a control transistor 209. The control transistor 209 receives a control signal 203 from the controller 201 and sinks a controlled current through the LED series 205. The constant current is confirmed by a feed back voltage 213 and a current sense resistor 211. The control signal 203 is adjusted if the feedback circuit does not confirm the actual current is the same as the current setting.

Alternatively, the switch 207 may be connected between points 1 and 2 in a second position. The alternative connection incorporates a circuit including an LED series 215, which is bypassed in the first position. The high voltage side of the LED series 215 is connected to the low voltage side of the LED series 205 and the low voltage side of the LED series 215 is connected to the control transistor 209. The alternative connection includes both LED series 205 and 215 in the circuit. Correspondingly, the total forward voltage of the circuit would increase; however, a maximum forward voltage is designed to be within the operating range of the floating voltage supply (vcc).

The LED series 215 emits a different color light than the LED series 205. For example, the LED series 215 may emit red or amber light, for example, visible light with wavelengths between about 575 nanometer (nm) to about 680 nm. When incorporated into the circuit, the light from the LED series 215 mixes with the light from the LED series 205 to produce a lamp output that has a different color temperature, for example a warmer white light. In some embodiments, the LED series 215 may be a blue light, for example, visible light with wavelengths between about 430 nm to about 500 nm. In these embodiments, the LED series 205 may generate a warm white light and when blue light from the LED series 215 is incorporated, a cooler light with a higher color temperature is produced.

In one example when the LED series 215 is red or amber light, a ratio of the number of LEDs in LED series 215 to the white LEDs in LED series 205 may be about 1 to 4, assuming that the die size is about the same, so that the output light stays within a white visible output range. Depending on the LED color of the LED series 215, adding too much light in a different color to the white light may excessively shift the output color so that the light output no longer appears white. A further consideration is that the total forward voltage must be within the operating voltage range of the floating voltage source.

In still other embodiments, the LED series 215 may be white light having a different color temperature from LED series 205. While incorporating white LED series 215 would also change the overall color temperature of the lamp output, the difference would be smaller than incorporating LED series 215 with red/amber LEDs or blue LEDs.

Figure 2B:
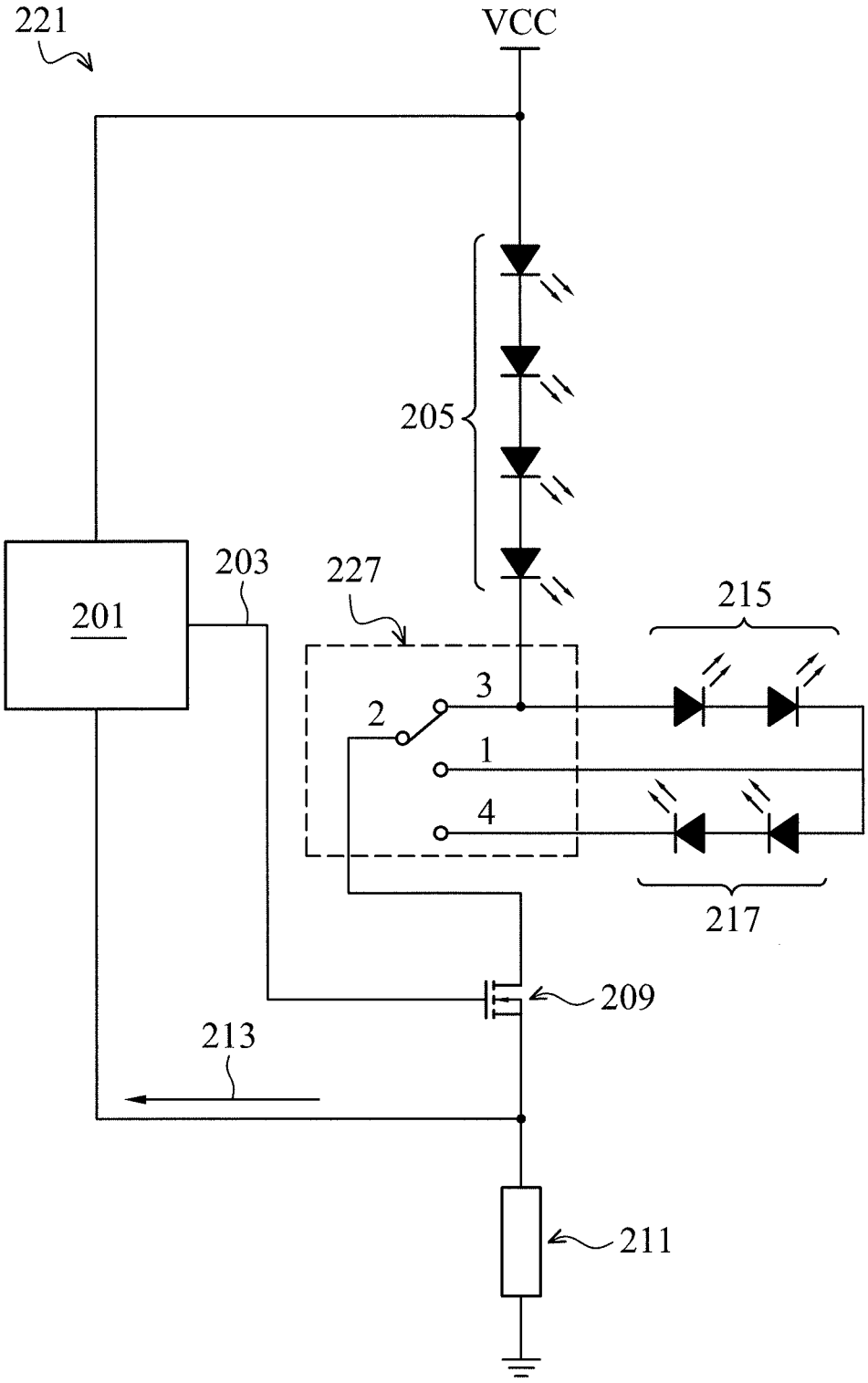

Switch 207 may include more than two positions. Additional positions may incorporate additional LED series (not shown) having yet different colors either singly or in combination. For example, FIG. 2B shows an alternate LED lamp circuit 221 with a three-way switch 227 with connections to the first LED series 205, a second LED series 215, and a third LED series 217. If the switch 227 connects between positions 2 and 3, only the first LED series 205 is connected in the circuit. If the switch 227 connects between positions 1 and 2, then the second LED series 215 is connected in addition to the first LED series 205. If the switch 227 connects between positions 2 and 4, then the first LED series 205, the second LED series 215, and the third LED series 217 are all connected. The second LED series 215 and third LED series 217 may emit the same color light or different color light. Thus a different color temperature white light may be produced by the LED lamp when the switch is in different positions. In some embodiments, yet another switch position can be included that bypasses the second LED series 215 and connects only the first LED series 205 to the third LED series 217. As discussed, the maximum forward voltage with all the LED series connected is within the operating range of the floating voltage supply.

While the LED series of FIGS. 2A and 2B are shown with two or four LED symbols, the LED series of a lamp circuit may have any number of LEDs in a series that comports with the power supply design and floating voltage operating range. In accordance with the user switch and circuit concepts, many LED series may be implemented in one LED lamp with a user controlled switch mechanism to operate the various LED series combinations.

Figure 3A:
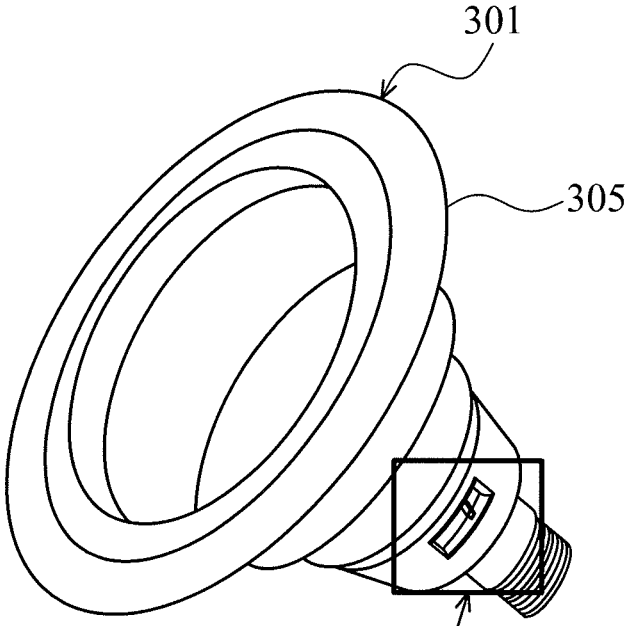
FIGS. 3A and 3B illustrate LED lamps according to certain embodiments of the present disclosure.
Figure 3B:
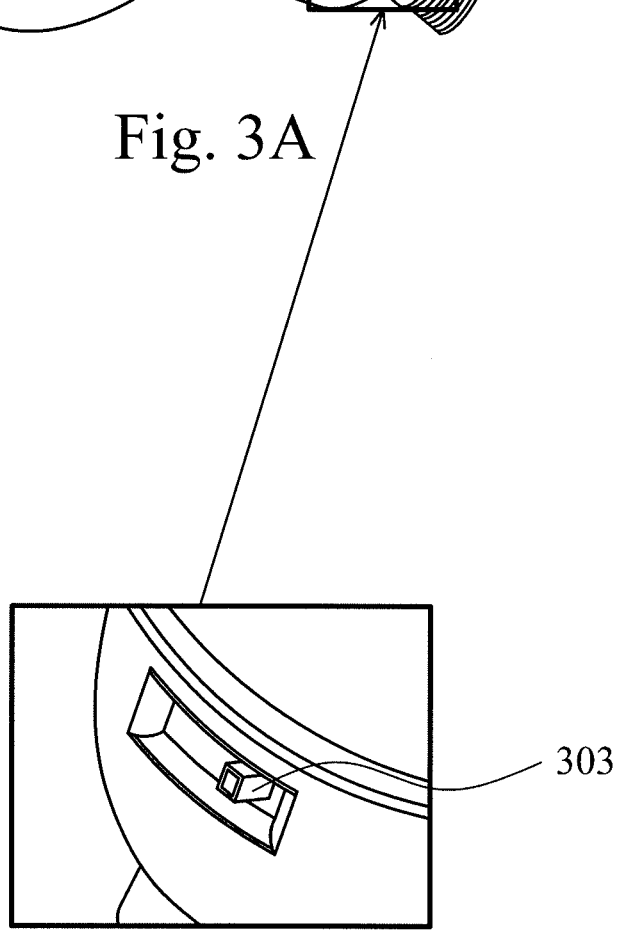

The switches 207 of FIG. 2A and 227 of FIG. 2B may be any type of mechanical or electrical switch that can be used to select different circuit pathways. Examples include, but are not limited to, toggle switches, sliding switches, button switches, or knob switches. FIGS. 3A and 3B show an example LED lamp with an external switch in accordance with various embodiments of the present disclosure. The LED lamp 301 in FIG. 3A has a lamp casing 305 that includes a user switch 303 as shown in more detail in FIG. 3B. The user switch 303 shown is a sliding switch that has at least two positions. In some embodiments, the user switch 303 mechanically operates the connections by moving metal connections directly or through levers and pivots. When the user switch 303 is positioned to a different position, the internal connector is moved also. Other mechanical switches such as toggle switches or knob switches may be used, as well as other suitable switch types.

In other cases, the user switch 303 is a user interface for the internal switch. For example, the user switch 303 may electrically operate the internal switch. The internal switch may or may not be a mechanical switch. For example, the internal switch may be a circuit of transistors in a multiplexing configuration. Each position change on the user switch may alter the connection in the internal switch. For example, if three LED series are used with a button switch as the user switch, the first button press may result in only the first LED series being lit. The second button press may result in the first and second LED series being lit. The third button press may result in the first and third LED series being lit. The fourth button press may result in the first, second, and third LED series being lit. The LED may also have a separate "off" switch to open the circuit for all LEDs. However, the "off" position may also be incorporated into the user switch. Examples of electrical switches include toggle switches, button switches, or knob switches.

Other embodiments of user switch design and configuration are possible. A design that anticipates a user not changing the color temperature setting very often may make the user switch smaller, behind a small cover, or can only be operated with special tools. In one example, the user switch may be multiple electrical pins adjusted with a shunt jumper. The user would place the shunt jumper over the pins corresponding to the desired connection. Another example would be a dual in-line package (DIP) switch that is effectively used in place of jumpers to configure the circuit.

Figure 4:
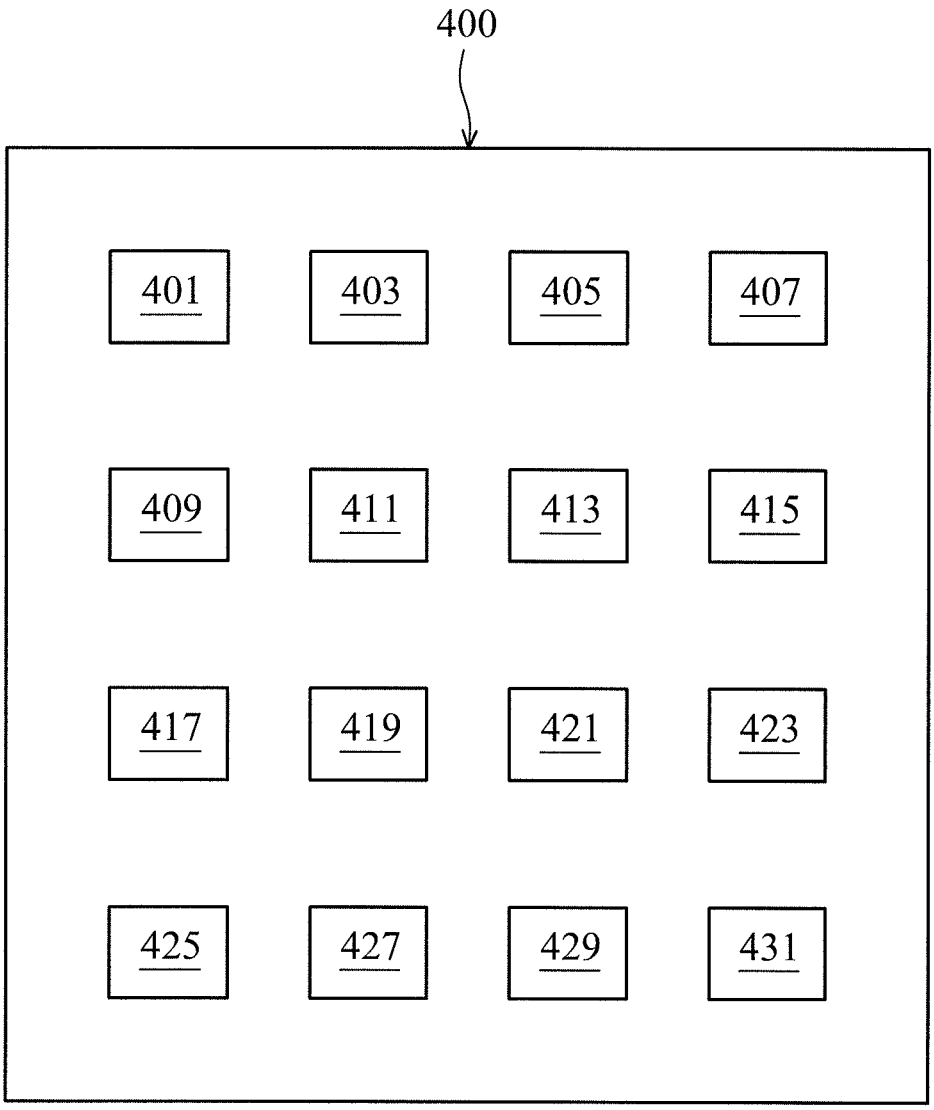
FIG. 4 illustrates example LED die layout in an LED lamp according to various aspects of the present disclosure.

FIG. 4 shows example LED die layouts on an LED light module 400. A number of LED dies 401 to 431 are mounted to a packaging substrate. The number of LED dies on a packaging substrate would vary with the light output requirements of the LED lamp, the number of LED series in the circuit, and the individual LED die size. Each of the LED dies 401 to 431 may include one or more LEDs. If more than one LED is included on a die, then any electrical connections between the LEDs on the die are formed before mounting on the package substrate. Electrical connections between LED dies may be pre-formed on the packaging substrate, with some additional bonding applied after mounting. In one example, the LED dies are vertical chips having one electrode mounted directly on the package substrate and the other electrode on top of the dies. Electrical connection between the top electrode of the die and the contacts on the package substrate may be a wire bond, a metal line printed or deposited on the package substrate after mounting the dies, or other suitable methods to electrically connect the top electrode to the circuit. If the LED dies are horizontal chips having electrodes on the sides, then two wire bonds or two metal lines may be deposited per die to connect each die to the circuit. In still other examples, the LED dies are flip chips, where both electrodes are on the same side of the LED dies. The LED dies are soldered or otherwise bonded to the package substrate without any metal wires or metal lines on the top surface of the LED die.

An example layout of the LED dies in accordance with some embodiments of the present disclosure may include 12 LED dies 401 to 431 as shown in FIG. 4, which includes two or more LED series. The primary white LED series includes up to 11 dies, and a secondary LED series includes at least one die. The one or more LED dies in the secondary LED series are dispersed in the layout so as to affect the color uniformity in the light output. If the secondary LED series includes only one LED die, the die may be one of the center dies, for example 411, 413, 419, or 421. If the secondary LED series includes two LED dies, then the LED die pair is dispersed and balanced in the layout. For example, the LED die pair may be 401/431, 425/407, 411/421, 415/417, 405/427, etc. If the secondary LED series includes three or more LED dies, then the same concept would apply to disperse the LED dies in the secondary series in the layout, so as to not affect the color temperature uniformity in the light output.

In some examples, more than one bypass LED series are included in the circuit. The LED dies in the multiple LED series should also be placed in a balanced and dispersed manner. For example, if two additional LED series are included and each includes 2 LED dies, then one LED series may be placed at 405/427 and the other LED series may be placed at 409/423.

The present disclosure also pertains to an LED lamp or a lighting system having LED lamps and controller that can operate the switches. The controller may incorporate optional LED series or bypass one or more LED series from the circuit using a measurement result to compensate for LED aging. As LEDs age, the light output may decrease over time. If a light measurement shows a decreased light output, the controller may add one or more LED series in the circuit to compensate for the decreased light output so that the total light output is closer to the original. Aged LEDs may also shift the output color temperature. Phosphors applied to the LEDs are known to decrease its conversion efficiency. Thus, a blue LED with yellow phosphor may shift to more blue, and hence colder color temperature, when the yellow phosphor decreases in conversion efficiency. In these cases, the controller may add one or more LED series to the circuit to maintain the color temperature.

The output light intensity or color temperature may be measured by a photo sensor disposed to receive light from the lamp. The photo sensor measurement may be an intensity or a color temperature. The photo sensor output is compared to a baseline value that is set according to the as-manufactured output of the lamp. If the photo sensor output is found to deviate significantly from the baseline value, then the controller may operate the switches to incorporate one or more LED series to compensate for the different measurement.

In still other embodiments, a system to control an interior environment may include a number of LED lamps and a controller that controls the lamps at the same time. In response to user input or environmental conditions such as time or day or reduced ambient light from outside due to cloudy conditions, the system controller may incorporate additional LED series or bypass certain LED series to adjust the indoor environment. One such system may adjust the indoor environment so that overall lighting is consistent regardless of availability of outside light, for example, for library reading rooms. Another system may adjust the indoor environment depending on light use. For example, different indoor lighting characteristics, including light intensity and color temperature, may be appropriate when watching television, having dinner, and doing homework. These different activities may have lighting characteristics that are preset by a system designer, but can be changed by the consumer based on preferences. Other types of control schemes include an energy saving scheme where least power is used to generate a minimum amount of light, a maximum lighting scheme where a highest light output is produced, or efficiency scheme when the efficiency in terms of light per power used (lumens/watt) is at a maximum. A user may also simply input a desired color temperature in terms of Kelvins.

Figure 5:
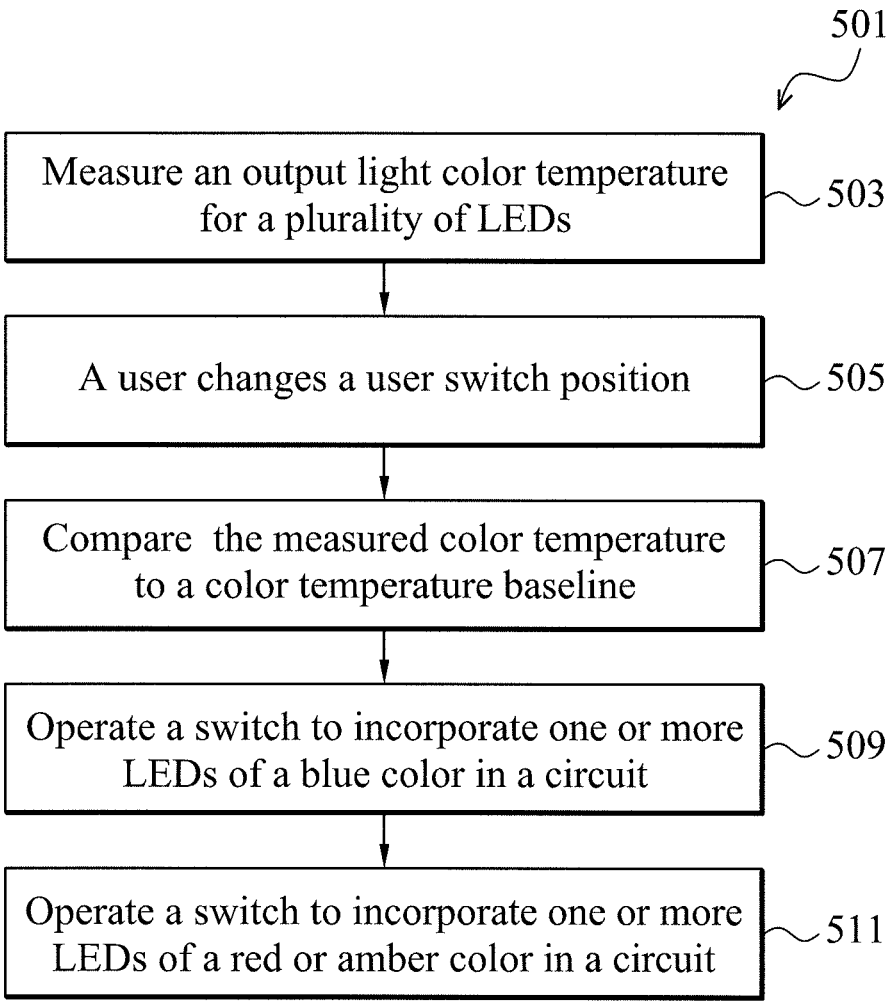
FIG. 5 is a flowchart illustrating a method of using an LED lamp according to certain embodiments of the present disclosure.

The present disclosure also pertains to a method of operating an LED lamp in accordance with various embodiments as shown in FIG. 5. The method 501 starts with operation 503 where an output light color temperature for a plurality of LEDs is measured. The measurement may occur internal to the LED lamp or outside of the LED lamp. Outside of the LED lamp, the light color temperature for a group of LED lamps, for a single LED lamp, or for an interior space may be measured.

Before or after the measurement, a user may change a user switch position in operation 505. The change in switch condition may indicate a user preference for a colder or warmer color temperature. The user switch may be located on the LED lamp or be located remotely on a controller that would operate internal switches on the LED lamp. In some embodiments, the light color temperature is not measured first and any change in light output merely corresponds to user input.

In operation 507, the measured color temperature, if performed, is compared to a color temperature baseline. The baseline may be a factory determined value for normal operation of the LED lamp. The baseline may also be a preset value based on a user input, for example, a user may preset that a switch position for reading indicates a color temperature of about 6000 Kelvins or a switch position for eating is about 4000 Kelvins.

In operation 509, the position of a switch is changed to incorporate one or more LEDs of a blue color in a circuit or to bypass one or more LEDs of a red or amber color from a circuit. When the measured color temperature and the color temperature baseline differs by a predetermined amount, the amount of shift may correspond to the difference in light color temperature by incorporating one or more LEDs of a blue color. By shifting the color temperature toward a cooler temperature, an output light from the circuit is closer to the color temperature baseline after the operation.

On the other hand, the position of a switch may be changed to incorporate the one or more LEDs of a red or amber color in the circuit or to bypass one or more LEDs of a blue color from a circuit. The difference between measured color temperature and the baseline may correspond to the difference in light color temperature by incorporating one or more LEDs of a red or amber color. By shifting the color temperature toward a warmer temperature, the output light from the circuit is closer to the color temperature baseline after the operation.

In some cases, the difference between the measured color temperature and the baseline may be smaller than an amount of shift that corresponds to incorporating one or more LEDs. No changes to the LED circuit may occur, because a switch change would not cause the output light from the circuit to be closer to the color temperature baseline. The switch change of operation 509 and 511 may incorporate one or more LED series or bypass one or more LED series or both. In the case where both one or more LED series of a first color is incorporated and one or more LED series of a second color is bypassed, the first color and the second color are different. The first color may be blue and the second color may be red or amber to shift the color temperature toward a cooler color. The first color may also be red or amber and the second color may be blue to shift the color temperature toward a warmer color.

The present disclosure also pertains to an LED lamp that includes a primary LED series of a first color and at least one secondary LED series of a second or additional colors. The LED lamp also includes a phosphor cap over the primary and secondary LED series, electrical lines coupling the LEDs in a series and between the LED series, one or more internal switches configured to couple the LED series, and a power supply to provide a constant current to the plurality of LEDs. The first color may be blue or UV.

If the first color is blue, then the phosphor cap may include yellow phosphor or a combination of red and green phosphors. The phosphor cap converts a portion of the light emitted by the primary and secondary LED series to a different color having a longer wavelength than the light emitted. Together with the unconverted portion of the light emitted, the LED lamp is perceived to generate a white light of a first color temperature. If the switch is activated to incorporate one or more of the secondary LED series, than the white light generated would be perceived to be of a second color temperature.

If the first color is ultraviolet (UV), then the phosphor cap includes blue phosphor in addition to yellow or a combination of red and green phosphors. For lighting purposes, substantially all of the light emitted by the primary and secondary LED series is converted. The mixture of converted light by various phosphors is perceived to be white.

As discussed, the one or more secondary LED series emit a second color and/or additional colors. The second color is different from the first color in order to modify the color temperature in the perceived light mixture. Additional colors may be different from the first color or be the same as the first color. For example, an LED lamp in accordance with this example may include a primary blue LED series, a secondary red LED series, and a secondary amber LED series. Depending on the user preference for the white light color temperature, only the primary series may be used, or the primary series with one of the secondary series, or the primary series with both of the secondary series may be used. By adding and/or bypassing various loops, an LED lamp designer can offer varying levels of flexibility for the user.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A lamp comprising:

a plurality of light emitting diodes (LEDs) including white LEDs and at least one red or amber LED;

an internal switch configured to couple the white LEDs and the at least one red or amber LED, the internal switch operable to bypass the at least one red or amber LED;

a floating voltage supply to which the plurality of LEDs is coupled;

a photo sensor disposed to receive light generated by the lamp;

a lamp casing including a user switch; and, a controller to receive a signal from the photo sensor and the user switch and to operate the internal switch in one of:

a first state where the white LEDs are electrically coupled in series with the red or amber LEDs; and a second state where the red or amber LEDs are electrically bypassed; and a transistor electrically coupled in series with the internal switch.

2. The lamp of claim 1, wherein the user switch is electrically connected to the internal switch to operate the internal switch.

3. The lamp of claim 2, wherein the user switch is a toggle switch, a sliding switch, a button switch, or a knob switch.

4. The lamp of claim 2, wherein the user switch has more than two positions, wherein each position completes a circuit to a different number of the plurality of light emitting diodes and generates a different color temperature light from the lamp.

5. The lamp of claim 1, wherein the plurality of LEDs further include at least one LED of a different color and the lamp further comprises a second internal switch between the at least one LED of a different color and the white LEDs.

6. The lamp of claim 5, wherein the different color is blue or yellow.

7. The lamp of claim 5, wherein the second internal switch is operable to connect all of the plurality of LEDs in series or to bypass the at least one LED of a different color.

8. The lamp of claim 1, wherein the at least one red or amber LED is disposed in center of the plurality of LEDs.

9. The lamp of claim 1, wherein the at least one red or amber LED is fewer than 25% of a number of white LEDs.

10. A lamp comprising:

a lamp casing;

a plurality of light emitting diodes (LEDs) including a plurality of white LEDs and a plurality of red or amber LEDs;

electrical lines between the plurality of white LEDs;

a switching mechanism electrically coupled to the white LEDs and to the red or amber LEDs, the switching mechanism being configured to operate in one of:

a first state where the white LEDs are electrically coupled in series with the red or amber LEDs; and a second state where the red or amber LEDs are electrically bypassed;

a transistor electrically coupled to the switching mechanism in series;

a controller electrically coupled to the transistor, wherein the controller is configured to generate and send a control signal to the transistor such that the transistor sinks a current in response to the control signal; and a user switch configured to operate the one or more internal switches.

11. The lamp of claim 10, wherein the user switch is a toggle switch, a sliding switch, a button switch, or a knob switch.

12. The lamp of claim 11, wherein the user switch operates the one or more internal switches in a predetermined sequence such that the lamp output lights have increasing or decreasing color temperatures.

13. The lamp of claim 10, wherein the user switch has more than two positions, wherein each position completes a circuit to a different number of the plurality of light emitting diodes and generates a different color temperature light from the lamp.

14. The lamp of claim 10, wherein the plurality of LEDs further include at least one LED of a blue color and the lamp further comprises another internal switch configured to couple the at least one LED of a blue color and the white LEDs, and wherein the another internal switch is operable to connect all of the plurality of LEDs in series or to bypass the at least one LED of a blue color.

15. A method of operating a circuit, comprising:

measuring an output light color temperature for a plurality of first LEDs in the circuit, the first LED having a first color temperature;

comparing the measured color temperature to a color temperature baseline;

operating a switch to incorporate one or more second LEDs of a second color temperature in the circuit when the measured color temperature and the color temperature baseline differs by a predetermined amount so that an output light from the circuit is closer to the color temperature baseline, wherein the second LEDs are electrically bypassed prior to the operating of the switch.

16. A method comprising:

providing power to one or more LED series in an LED lamp;

receiving a change in a position of a user switch implemented on an LED lamp casing;

operating an internal switch to incorporate one or more LEDs of a first color different from a color of the one or more LED series and/or to bypass one or more LEDs of a second color different from the color of the one or more LED series.

17. The method of claim 16, wherein the first color is red or amber.

18. The lamp of claim 1, further comprising a transistor coupled in series with the internal switch, wherein the transistor is configured to:

receive a control signal generated by the controller; and sink a controlled current in response to the control signal.

19. The lamp of claim 10, wherein the user switch is a mechanically-operable mechanism implemented on the lamp casing.

20. The lamp of claim 10, further comprising a current sensing resistor electrically coupled in series with the transistor, and wherein the controller is further coupled to a node between the transistor and the current sensing resistor so as to receive a feedback voltage from the node.

21. A lamp comprising:

a floating voltage supply;

a first LED series electrically coupled to the floating voltage supply, the first LED series having a first color temperature;

a second LED series electrically coupled to the first LED series, the second LED series having a second color temperature;

a third LED series electrically coupled to the second LED series, the third LED series having a third color temperature;

a multi-way switch electrically coupled to the first, second, and third LED series, wherein the multi-way switch is configured to operate in:

a first state where both the second and third LED series are electrically bypassed;

a second state where the second LED series is electrically coupled in series to the first LED series but the third LED series is electrically bypassed; and a third state where the first, second, and third LED series are all electrically coupled in series;

a control transistor electrically coupled to the multi-way switch in series;

a current sensing resistor electrically coupled to the control transistor; and a controller electrically coupled to a node between the control transistor and the current sensing resistor so as to receive a feedback voltage, and wherein in response to the feedback voltage, the controller produces a control signal to drive the control transistor to sink a controlled amount of electrical current.

* * * * *